US009123979B1

(12) United States Patent
Izadian

(10) Patent No.: US 9,123,979 B1
(45) **Date of Patent: *Sep. 1, 2015**

(54) PRINTED WAVEGUIDE TRANSMISSION LINE HAVING LAYERS WITH THROUGH-HOLES HAVING ALTERNATING GREATER/LESSER WIDTHS IN ADJACENT LAYERS

(71) Applicant: Google Inc., Mountain View, CA (US)

(72) Inventor: Jamal S. Izadian, Mountain View, CA (US)

(73) Assignee: Google Inc., Mountain View, CA (US)

( * ) Notice: Subject to any disclaimer, the term of this patent is extended or adjusted under 35 U.S.C. 154(b) by 223 days.

This patent is subject to a terminal disclaimer.

(21) Appl. No.: 13/852,416

(22) Filed: Mar. 28, 2013

(51) Int. Cl.
*H01P 3/18* (2006.01)
*H01P 3/00* (2006.01)

(52) U.S. Cl.
CPC ... *H01P 3/00* (2013.01); *H01P 3/18* (2013.01)

(58) Field of Classification Search
CPC ..... H01P 3/121; H01P 3/18; H01P 3/165; H01P 3/12
USPC ..... 333/239, 248, 113, 114
See application file for complete search history.

(56) References Cited

U.S. PATENT DOCUMENTS

| | | | | |
|---|---|---|---|---|
| 3,854,083 | A | 12/1974 | Hulderman et al. | |
| 4,918,411 | A | 4/1990 | Staehlin et al. | |
| 5,977,924 | A | 11/1999 | Takei | |
| 5,982,256 | A * | 11/1999 | Uchimura et al. | 333/239 |
| 6,285,335 | B1 | 9/2001 | Snygg | |
| 6,822,534 | B2 | 11/2004 | Uriu | |
| 7,215,007 | B2 | 5/2007 | McKinzie, III | |
| 7,227,428 | B2 | 6/2007 | Fukunaga | |
| 8,040,286 | B2 | 10/2011 | Matsuo | |
| 8,188,805 | B2 | 5/2012 | Nomura | |
| 8,212,580 | B2 | 7/2012 | Izadian | |
| 2006/0226931 | A1 | 10/2006 | Tavassoli Hozouri | |

(Continued)

FOREIGN PATENT DOCUMENTS

| | | |
|---|---|---|
| JP | 2001156510 | 6/2001 |
| WO | 2009023551 | 2/2009 |

OTHER PUBLICATIONS

Non-Final Office Action for corresponding U.S. Appl. No. 13/851,469, dated Jan. 20, 2015.

(Continued)

*Primary Examiner* — Benny Lee
(74) *Attorney, Agent, or Firm* — McDonnell Boehnen Hulbert & Berghoff LLP

(57) ABSTRACT

Example multi-layer apparatus for electromagnetic waves and methods for fabricating such apparatus are described. An example apparatus may include a first conducting layer including an input port and a second conducting layer including at least one through-hole. The apparatus may also include a first layer between the first conducting layer and the second conducting layer, including a first waveguide aligned at least in part with the input port and the at least one through-hole. The apparatus may also include a third conducting layer including an output port. The apparatus may also include a second layer between the second conducting layer and the third conducting layer, including a second waveguide aligned at least in part with the output port and the at least one through-hole. The at least one through-hole may be configured to couple millimeter electromagnetic waves from the first waveguide to the second waveguide.

17 Claims, 9 Drawing Sheets

(56) References Cited

U.S. PATENT DOCUMENTS

| | | | | |
|---|---|---|---|---|
| 2007/0262828 | A1* | 11/2007 | Fujita | 333/26 |
| 2008/0150821 | A1 | 6/2008 | Koch | |
| 2008/0169349 | A1 | 7/2008 | Suzuki | |
| 2009/0309680 | A1* | 12/2009 | Suzuki | 333/254 |
| 2010/0307798 | A1 | 12/2010 | Izadian | |
| 2011/0001584 | A1 | 1/2011 | Enokihara | |
| 2011/0018657 | A1 | 1/2011 | Cheng | |
| 2012/0050125 | A1 | 3/2012 | Leiba | |
| 2012/0056776 | A1 | 3/2012 | Shijo | |
| 2012/0306598 | A1 | 12/2012 | Izadian | |

OTHER PUBLICATIONS

Non-Final Office Action for corresponding U.S. Appl. No. 13/854,190, dated Dec. 29, 2014.

* cited by examiner

PRINTED WAVEGUIDE TRANSMISSION LINE HAVING LAYERS WITH THROUGH-HOLES HAVING ALTERNATING GREATER/LESSER WIDTHS IN ADJACENT LAYERS

BACKGROUND

Unless otherwise indicated herein, the materials described in this section are not prior art to the claims in this application and are not admitted to be prior art by inclusion in this section.

In communications and electronic engineering, a transmission line is a specialized cable designed to carry alternating current of radio frequency, that is, current with a frequency high enough that their wave nature are taken into account. Transmission lines are used for purposes such as connecting radio transmitter and receivers with their antennas, distributing cable television signals, and computer network connections. Transmission lines use techniques, such as precise conductor dimensions and spacing, and impedance matching, to carry electromagnetic signals with minimal reflections and power losses. Types of transmission lines include coaxial cable, stripline, optical fiber, and waveguides, for example.

SUMMARY

In one aspect, the present disclosure provides an apparatus. The apparatus may include a first conducting layer including an input port, where the input port is configured to transmit millimeter electromagnetic waves. The apparatus may also include a second conducting layer including at least one through-hole. The apparatus may also include a first layer between the first conducting layer and the second conducting layer. The first layer may include a first waveguide that is aligned at least in part with the input port and the at least one through-hole of the second conducting layer. The apparatus may also include a third conducting layer including an output port, where the output port is configured to receive millimeter electromagnetic waves. The apparatus may also include a second layer between the second conducting layer and the third conducting layer. The second layer may include a second waveguide that is aligned at least in part with the output port and the at least one through-hole of the second conducting layer. The at least one through-hole of the second conducting layer may be configured to couple millimeter electromagnetic waves from the first waveguide to the second waveguide.

In another aspect, the present disclosure provides a method. The method may comprise forming a first conducting layer including an input port, where the input port is configured to transmit millimeter electromagnetic waves. The method may further comprise forming a second conducting layer including at least one through-hole. The method also may comprise forming a first layer between the first conducting layer and the second conducting layer. The first layer may include a first waveguide that is aligned at least in part with the input port and the at least one through-hole of the second conducting layer. The method may further comprise forming a third conducting layer including an output port, where the output port is configured to receive millimeter electromagnetic waves. The method may further comprise forming a second layer between the second conducting layer and the third conducting layer. The second layer may include a second waveguide that is aligned at least in part with the output port and the at least one through-hole of the second conducting layer. The at least one through-hole of the second conducting layer may be configured to couple millimeter electromagnetic waves from the first waveguide to the second waveguide.

In yet another aspect, the present disclosure provides another method. The method may comprise forming a first layer comprising a first dielectric layer coupled between a first conducting layer and second conducting layer. The first layer may include an input port configured to transmit millimeter electromagnetic waves. The method may further comprise forming a second layer coupled to the first layer and comprising a second dielectric layer coupled between a third conducting layer and fourth conducting layer. The second layer may include a first waveguide that is aligned at least in part with the input port. The method may further comprise forming a third layer coupled to the second layer and comprising a third dielectric layer coupled between a fifth conducting layer and sixth conducting layer. The third layer may include at least one through-hole that is aligned at least in part with the first waveguide. The method may further comprise forming a fourth layer coupled to the third layer comprising a fourth dielectric layer coupled between a seventh conducting layer and an eighth conducting layer. The fourth layer may include a second waveguide that is aligned at least in part with the at least one through-hole of the third layer. The method may further comprise forming a fifth layer coupled to the fourth layer comprising a fifth dielectric layer coupled between a ninth conducting layer and a tenth conducting layer. The fifth layer may include an output port configured to receive millimeter electromagnetic waves. The output port may be aligned at least in part with the second waveguide. The at least one through-hole of the third layer may be configured to couple millimeter electromagnetic waves from the first waveguide to the second waveguide.

These as well as other aspects, advantages, and alternatives, will become apparent to those of ordinary skill in the art by reading the following detailed description, with reference where appropriate to the accompanying drawings.

DETAILED DESCRIPTION

Figure 1:
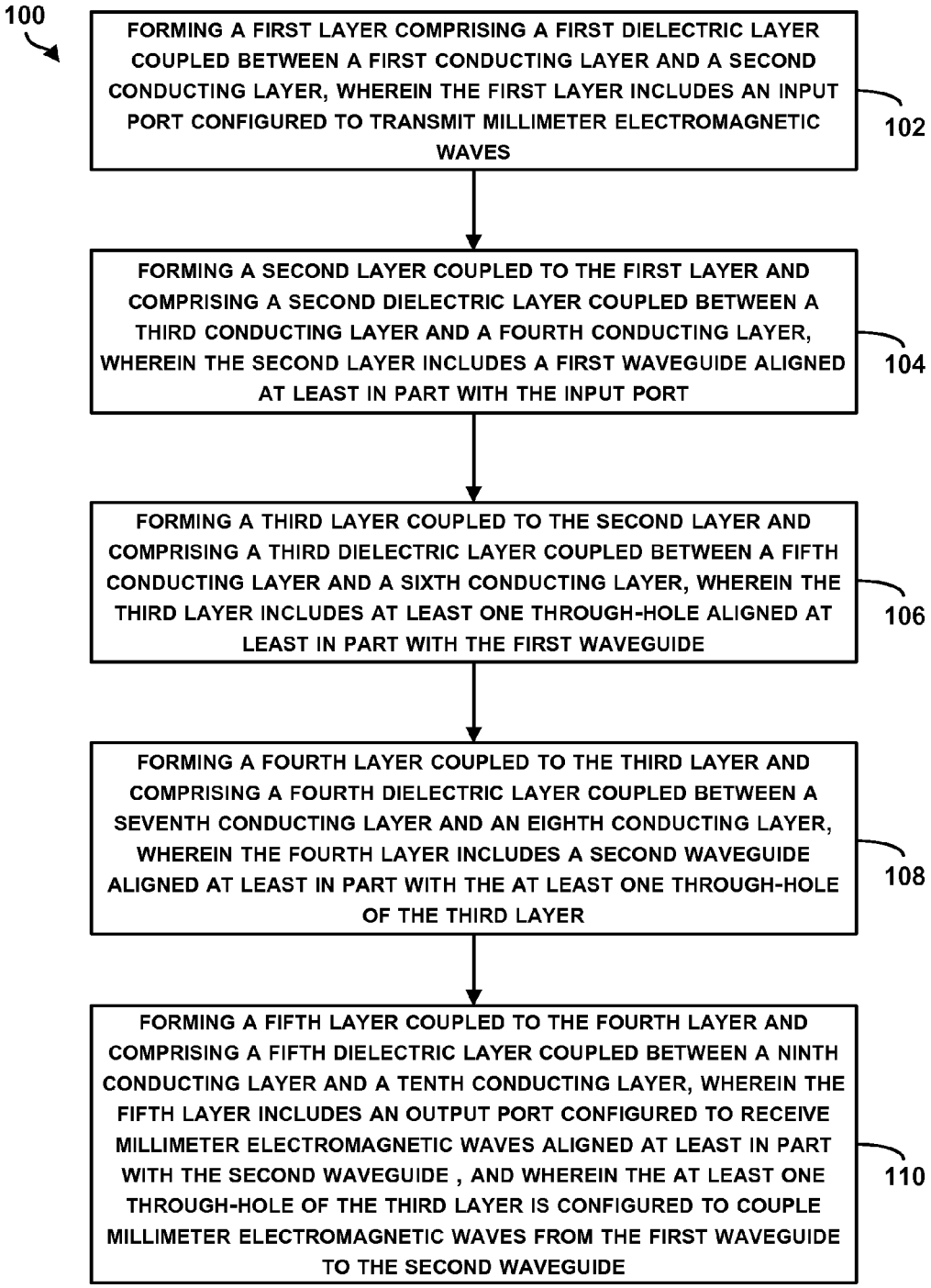
FIG. 1 is a flow chart of a method to form a coupling device using Printed Waveguide Transmission Lines (PWTL), in accordance with an example embodiment.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Waves in open space propagate in all directions, as spherical waves. In this manner, the waves lose power proportionally to the square of propagation distance; that is, at a distance R from the source, the power is the source power divided by $R^2$. A waveguide is a structure that guides waves, such as electromagnetic waves or sound waves. For instance, the waveguide may confine a wave to propagate in one dimension, so that, under certain conditions, the wave may lose no power while propagating. There are different types of waveguides for various types of waves. As an example, a waveguide may include a hollow conductive metal pipe used to carry high frequency radio waves or microwaves. As another example, a waveguide may be include a transmission line used to transmit high frequency radio waves or microwaves. Radio waves and microwaves may be collectively referred to herein as "millimeter waves" or "millimeter electromagnetic waves," as the shortest wavelength of such waves is 1 mm.

Geometry of a waveguide reflects its functions. Slab waveguides, for example, may confine energy to travel in one dimension, while fiber or channel waveguides may confine energy to travel in two dimensions. Waves are confined inside the waveguide due to reflection from walls of the waveguide, so that the propagation inside the waveguide can be described approximately as a "zigzag" between the walls. This description is applicable, for example, to electromagnetic waves in a hollow metal tube with a rectangular or circular cross-section. Frequency of the transmitted wave may also dictate the shape of a waveguide. As an example, an optical fiber guiding high-frequency light may not guide microwaves of a much lower frequency. Generally, width of a given waveguide may be of the same order of magnitude as a respective wavelength of the guided wave.

Waveguide transmission line technology can be used for transferring both power and communication signals, and may be implemented in radar systems, microwave ovens, satellite communications, high speed routers and cabling, and antenna systems, among others. Further, waveguide transmission line technology may be used to couple or filter communication signals.

Waveguides can be constructed to carry waves over a wide portion of the electromagnetic spectrum, such as in the microwave and optical frequency ranges. Depending on the frequency, the waveguides can be constructed from either conductive or dielectric materials. Some waveguide transmission lines may be manufactured by machining solid blocks of metal with channels in which the radio waves may travel. Additionally or alternatively, waveguide transmission lines may be manufactured using high-quality dielectric laminates. Such laminates may comprise conducting material (e.g., copper) electrodeposited in one or more surfaces of the laminate, and may further comprise additional conducting layers (e.g., copper, aluminum, and/or brass foils/plates).

Printed waveguide transmission lines (PWTLs) may comprise a multi-layer laminated structure including printed electronics, such as printed circuit boards (PCBs) comprising a dielectric material with an conducting material imaged (i.e., "printed") and deposited in the dielectric material. One embodiment of a PWTL may include rectangular channels formed in the multi-layer structure and configured to transmit/propagate transverse electric ($TE_{mn}$) waves, where m is a number of half-wavelengths across a width of the rectangular channel and n is the number of half-wavelengths across the height of the rectangular channel.

PWTLs, among other waveguide technologies, may provide precision in facilitating the propagation of millimeter electromagnetic wave signals in the radio frequency range (e.g., 77 GHz wave signals) with low energy/power losses, such as radiation loss, resistive loss, dielectric loss, or the like. In general, performance of a PWTL (including, but not limited to, the range of frequencies supported by the PWTL and the reduction of losses by the PWTL) may be commensurate with accuracy and precision of the manufacturing of the PWTL.

FIG. 1 is a flow chart of a method 100 to form a coupler using a PWTL. The PWTL, such as that described by the method 100, may be fabricated using components such as conducting layers and dielectric laminate layers. It should be understood that other methods of fabrication are also possible.

The method 100 may include one or more operations, functions, or actions as illustrated by one or more of blocks 102, 104, 106, 108, 110, and 112. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 102, the method 100 includes forming a first layer comprising a first dielectric layer coupled between a first conducting layer and a second conducting layer, wherein the first layer includes an input port configured to transmit millimeter electromagnetic waves. The conducting layers may vary in thickness, and may include a foil or other sheet metal. Further, the conducting layers may include copper, aluminum, a polyimide copper laminate, or any other conducting materials. The first dielectric layer may include a polyimide film, such as Kapton™. In one example, the input port may include a WR-10 flange. The WR designation stands for Waveguide Rectangular, and the number following the WR designation is the inner dimension width of the waveguide in hundredths of an inch. Therefore, a WR-10 flange has an inner dimension width of 0.10 inches. Other embodiments are possible as well.

Figure 2A:
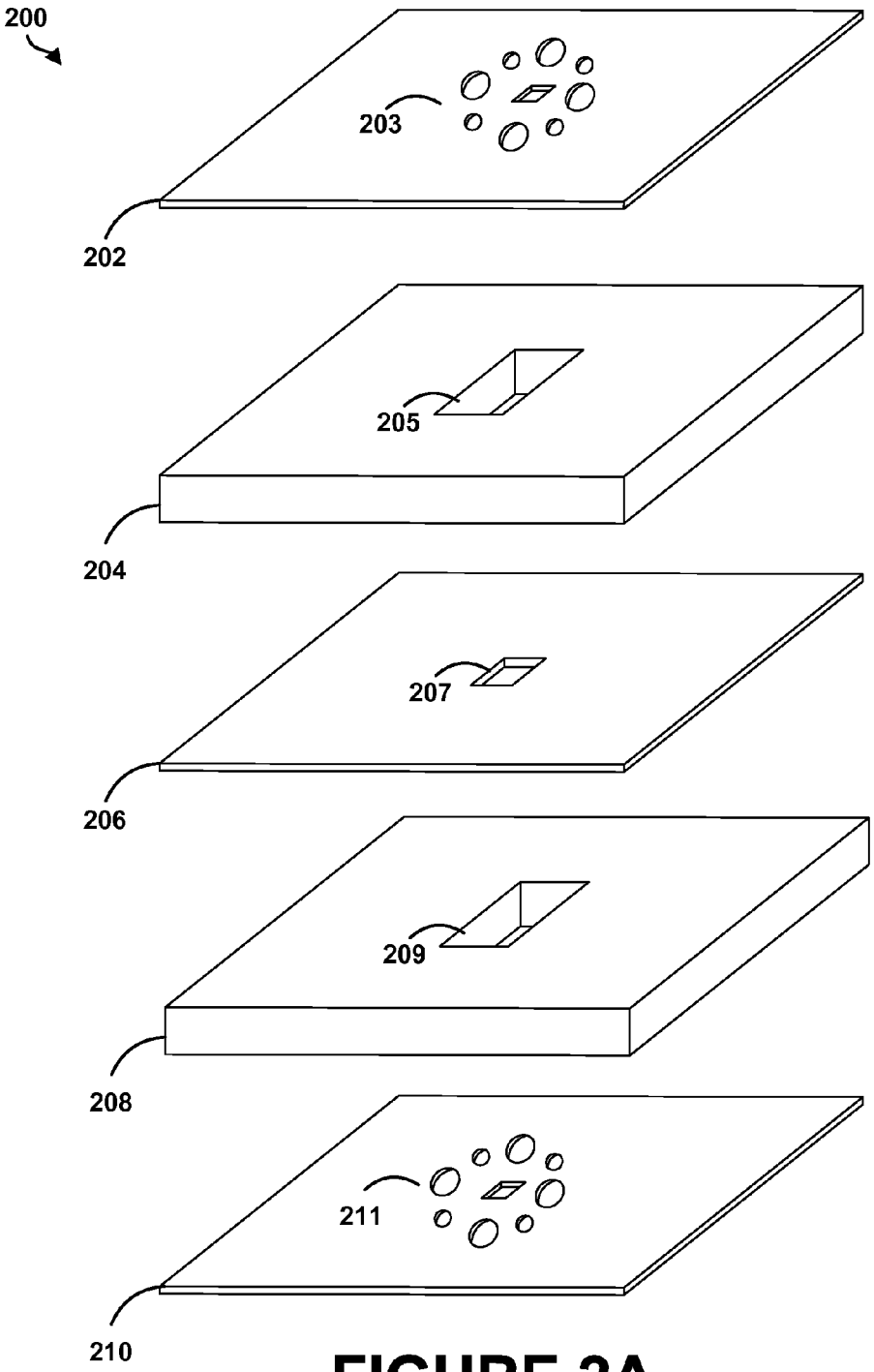
FIG. 2A illustrates an exploded view of different layers of an example multi-layer apparatus.

FIG. 2A illustrates an exploded view of different layers of an example PWTL apparatus 200. The apparatus 200 may include a first layer 202, and the first layer 202 may include an input port 203, as shown. The input port 203 shown is a WR-10 flange. It should be understood, however, that the input port 203 is an example for illustration and that the first layer 202, may include a different input port. Further, the first layer 202 may include a first and second conducting layer coupled to top and bottom surfaces of a first dielectric layer. The input port 203 may be drilled, reamed, etched, or formed using any other manufacturing technique appropriate for the material of the first dielectric layer and the conducting layers coupled to the first dielectric layer.

Referring back to FIG. 1, at block 104, the method 100 includes forming a second layer coupled to the first layer and comprising a second dielectric layer coupled between a third conducting layer and a fourth conducting layer, wherein the second layer includes a first waveguide that is aligned at least in part with the input port. The first waveguide may be formed by drilling, routing, reaming, etching, or otherwise machining the second layer. In some examples, the second dielectric layer may be thicker than the first dielectric layer.

As shown in FIG. 2A, the second layer 204 may be located underneath the first layer 202, and may include a first waveguide 205. The first waveguide 205 may include a single waveguide channel, or the first waveguide 205 may include several waveguide channels coupled together. The second layer 204 may be made of a dielectric material (e.g., the second dielectric layer) that is laminated with conducting layers (e.g., the third and fourth conducting layers) on both sides.

For instance, the second dielectric layer may include FR-4 material. FR-4 is a grade designation assigned to glass-reinforced epoxy laminate sheets, tubes, or rods, and FR-4 is a composite material composed of woven fiberglass cloth with an epoxy resin binder that is flame resistant (self-extinguishing). FR-4 glass epoxy is a versatile high-pressure thermoset plastic laminate grade used as an electrical insulator possessing considerable mechanical strength. The FR-4 material may be configured to retain high mechanical values and electrical insulating qualities in both dry and humid conditions. FR-4 epoxy resin may include bromine, a halogen, to facilitate flame-resistant properties in FR-4 glass epoxy laminates.

In some examples, the second dielectric layer may include additional conducting layers coupled to one or both sides of the second dielectric layer. For instance, the second dielectric layer may be made of FR-4 material, which may be laminated with conducting material on both sides (e.g., copper traces etched onto the FR-4 substrate). As such, additional laminates, such as other copper traces or full copper sheets, may be coupled to one or both sides of the second dielectric layer on top of the other laminates. The traces/laminates may be made of other conducting material as well. The traces formed may be similar to circuit-board traces, and such traces may implement electric circuitry and signal routing functionality.

Referring back to FIG. 1, at block 106, the method 100 includes forming a third layer coupled to the second layer and comprising a third dielectric layer coupled between a fifth conducting layer and a sixth conducting layer, wherein the third layer includes at least one through-hole that is aligned at least in part with the first waveguide.

Further, at block 108, the method 100 includes forming a fourth layer coupled to the third layer and comprising a fourth dielectric layer coupled between a seventh conducting layer and an eighth conducting layer, wherein the fourth layer includes a second waveguide that is aligned at least in part with the at least one through-hole of the third layer. The second waveguide may include a single waveguide channel, or the second waveguide may include several waveguide channels coupled together. The dielectric material of the fourth dielectric layer may be the same as or different from the dielectric material of the second dielectric layer, and the two conducting layers coupled to outer surfaces of the fourth dielectric layer may be made of copper, aluminum, or other conducting material. The fourth layer 208 may also include additional conducting layers.

With respect to FIG. 2A, the second layer 204, third layer 206, and fourth layer 208 may be made of FR-4 material, and the inner surface of the first waveguide 205, the at least one through-hole 207, and the second waveguide 209 may be a non-conductive surface of exposed FR-4 dielectric material. As such, a conducting material (e.g., a metallic material) may be deposited or plated on the inner surface of the first waveguide 205, the at least one through-hole 207, and the second waveguide 209.

Several techniques can be used to deposit or plate the inner surfaces of the through-holes and waveguides with a conducting material. The through-holes and waveguides may be preconditioned first. For example, several processes such as desmearing, hole conditioning, micro-etching, activation, and acceleration can be applied to precondition the through-holes. Each layer may then be dipped in solution where electroless copper can be deposited on the inner surfaces. Other techniques can be used to deposit or plate a metallic or conducting material on the inner surfaces of the through-holes. For instance, techniques used in printed circuit board (PCB) manufacturing can be used for forming each layer and depositing a conducting material on the inner surface of the through-holes and waveguides. Other embodiments are possible as well.

Plating the through-hole(s) of the third layer may enable the third layer to function as a coupling channel. For example, as shown in FIG. 2A, the apparatus 200 includes a second layer 204 and a fourth layer 208, each with respective waveguides 205, 209. In the apparatus 200 shown in FIG. 2A, the at least one through-hole 207 of the third layer 206, may act as a coupling channel with a conductive, plated inner surface to allow for the transmission of millimeter waves from the second layer 204 to the fourth layer 208, or from the fourth layer 208 to the second layer 204.

Referring back to FIG. 1, at block 110, the method 100 includes forming a fifth layer coupled to the fourth layer and comprising a fifth dielectric layer coupled between a ninth conducting layer and a tenth conducting layer, wherein the fifth layer includes an output port configured to receive millimeter electromagnetic waves that is aligned at least in part with the second waveguide, and wherein the at least one through-hole of the third layer is configured to couple millimeter electromagnetic waves from the first waveguide to the second waveguide.

With respect to FIG. 2A, the fifth layer 210 may be similar to or different from the first layer 202 and/or the third layer 206. In the example apparatus 200 of FIG. 2A, the output port 211 of the fifth layer 210 is shown as a WR-10 flange for illustrative purposes. However, the fifth layer 210 may include a different output port. Further, the fifth layer 210 may be made of material not described herein, and/or may include additional electronics.

Each of the input port 203, first waveguide 205, at least one through-hole 207, second waveguide 209 and output port 211 may include a respective shape and size. In the apparatus 200 shown in FIG. 2A, for example, the through-hole third layer 207 is smaller in size compared to the first and second waveguides 205, 209. In other examples, one or more of the waveguides or through-holes may include an angled shape (e.g., non-orthogonal to the respective layer). Other example sizes and shapes are possible.

In one embodiment, the method 100 may further include providing a respective adhesive between one or more of the first layer and the second layer, the second layer and the third layer, the third layer and the fourth layer, and the fourth layer and the fifth layer. The conducting adhesive may include solder paste, for example.

The conducing adhesive may be applied to areas surrounding the waveguides and through-hole(s) of the second, third, and fourth layers, so as to at least partially align the waveguides and through-hole(s) with each other and define an electromagnetic wave path through which millimeter electromagnetic waves may propagate. In some examples, the conducting adhesive may provide sufficient adhesion for coupling each layer together.

However, in other examples in which the conducting adhesive does not provide sufficient adhesion, an additional thin, non-conducting adhesive layer, such as a prepreg adhesive or double-sided adhesive Kapton™ tape, may be included between each of the layers. In such other examples, the non-conducting adhesive layer may be applied to an outer surface (e.g., at least a portion of the outer surface) of each layer surrounding the conducting adhesive. In still other examples, the non-conducting adhesive may be used without the conducting adhesive, and exposed non-conducting inner surfaces of the waveguides and through-hole(s) may be metallized. Other examples are also possible.

Figure 2B:
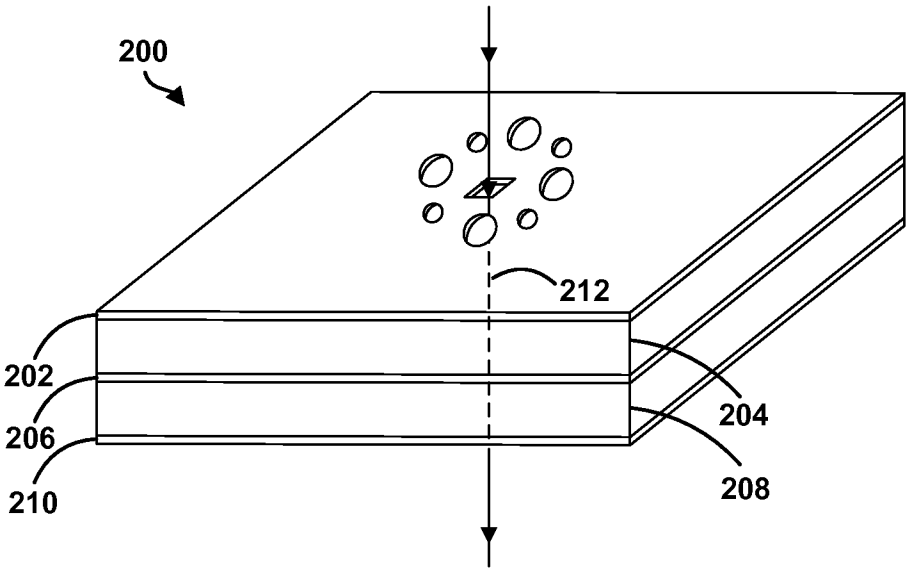
FIG. 2B illustrates an assembled view of the example multi-layer apparatus.

FIG. 2B illustrates an assembled view of the apparatus 200. After the layers are coupled together with the conducting adhesive and/or the non-conducting adhesive, a waveguide channel 212 may be formed through which millimeter electromagnetic waves may propagate. Further, the apparatus 200 shown in FIG. 2B may be coupled to other apparatuses similar to or different from the apparatus 200, so as to form a PWTL with an extended waveguide channel. In addition to the waveguide channel 212 shown in FIG. 2B, the apparatus 200 may include other waveguide channels (not shown) that are parallel to the waveguide channel 212 and orthogonal to each layer of the apparatus 200. In some examples, additionally or alternatively to the waveguide channel 212, the apparatus 200 may include waveguide channels that are non-orthogonal to each layer of the apparatus 200 (e.g., angled or zigzagged waveguide channels). Other examples are also possible. In general, the size and shape of the waveguide channels may be adjusted in order to tune performance (e.g., resonance characteristics, signal phases) of the PWTL.

Figure 2C:
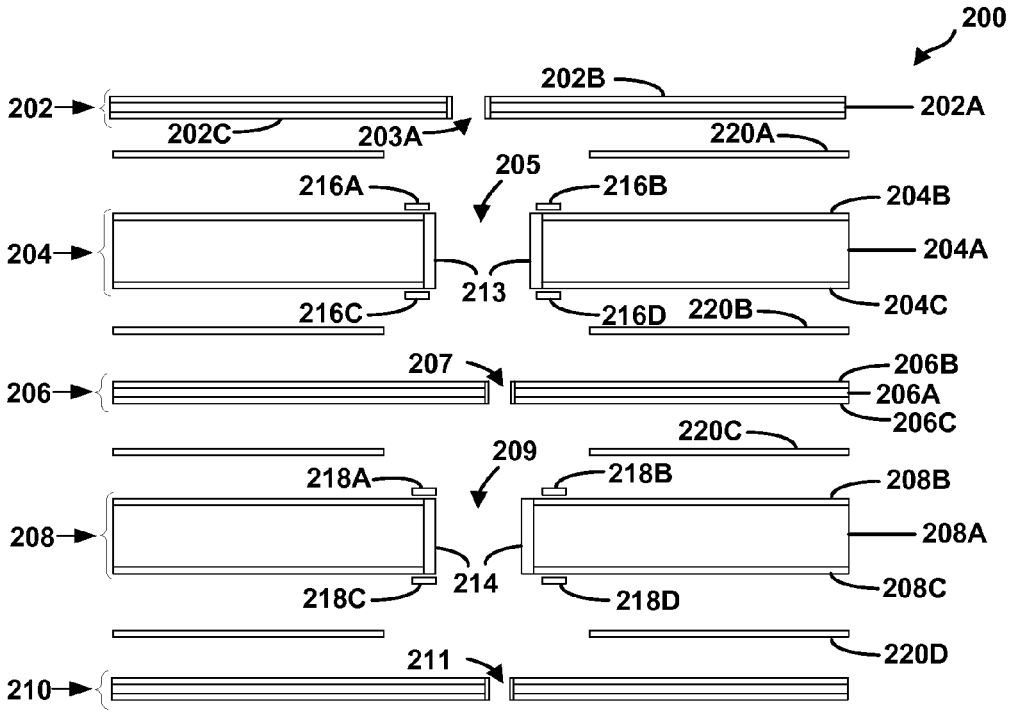
FIG. 2C illustrates an exploded view of a cross section of the example multi-layer apparatus.

FIG. 2C illustrates an exploded view of a cross section of the example apparatus 200. FIG. 2C also illustrates layer details not shown in the FIGS. 2A and 2B in order to further illustrate the fabrication and characteristics of the apparatus 200.

As described above, the first layer 202 may be made of a Kapton™ layer coupled to conducting layers (e.g., polyimide copper laminate), for example. In another example, the first layer 202 can be made of a conducting foil (e.g., a sheet of metal) that is not coupled to a dielectric layer. In FIG. 2C, the former example configuration is illustrated, where the first layer 202 includes a Kapton™ layer 202A, a first conducting layer 202B coupled to the Kapton™ layer 202A, and a second conducting layer 202C coupled to the Kapton™ layer 202A. Kapton™ is used herein as an example, and other dielectric materials can be used in other examples. The first layer 202 may include a hole, such as an input port 203A configured to transmit millimeter electromagnetic waves.

Similar to the first layer, the third layer 206 and the fifth layer 210 may also each include a metallic sheet or foil, or may each include a Kapton™ layer coupled to conducting layers. For example, the third layer 206 and the fifth layer 210 may be configured identically, and may include a Kapton™ layer 206A coupled to or laminated with two conducting layers (e.g., copper-clad laminates) 206B and 206C.

As described above and as illustrated in FIG. 2C, in some examples, the second layer 204 (and the fourth layer 208) may include dielectric material coupled to conducting layers (e.g., conducting sheet material). For instance, the second layer 204 may be composed of a dielectric layer (e.g., FR-4) 204A coupled to two conducting layers (e.g., sheets of copper laminates) 204B and 204C. Similarly, the fourth layer 208 may be composed of a dielectric layer (e.g., FR-4) 208A coupled to two conducting layers (e.g., sheets of copper laminates) 208B and 208C. Further, electric circuitry and traces and may be formed (e.g., imaged and etched using photolithography) on the two conducting layers of each of the second and fourth layers 204, 208 to implement electric circuits and associated functionality. In other examples, the second layer 204 and/or the fourth layer 208 may be made of conducting material (e.g., metallic material such as aluminum or copper).

In still other examples, the second layer 204 and the fourth layer 208 may not be made of the same material. For example, the second layer 204 may be made of a conducting material such as aluminum, and the fourth layer 208 may be made of FR-4 material coupled to two laminating conducting layers, or vice versa. Further, the first layer 202 may include material different from materials (e.g., conducting and non-conducting) used for the third layer 206 and/or the fifth layer 210. For instance, the first layer 202 may include only conducting material, while the third layer 206 and/or the fifth layer 210, may include a Kapton™ layer coupled between two laminating conducting layers. Other examples are also possible. In general, different combinations of material can be used for the different layers of the apparatus 200.

Regarding examples in which dielectric material is used to form the second layer 204, forming the first waveguide 205 may expose non-conducting inner surfaces. In these examples, a metallic plating 213 or other thin metal surface may be provided (e.g., deposited) on respective inner surfaces of the first waveguide 205 in the second layer 204. Similarly, regarding examples in which a dielectric material is used to form the fourth layer 208, forming the second waveguide 209 in the fourth layer 208 may expose non-conducting inner surfaces. In these examples, a metallic plating 214 or other thin metal surface may be provided on respective inner surfaces the second waveguide 209 in the fourth layer 208. Further, the metallic material used to plate the first waveguide 205 of the second layer 204 may be of similar or different material than the metallic material used to plate the waveguide 209 of the fourth layer 208. Other through-holes/channels in the apparatus 200 can also be plated if the layers in which the through-holes/channels are formed are made of dielectric materials. For example, the through-hole(s) 207 of the third layer 206 may be plated if the third layer 206 comprises a dielectric material 206A between two conducting layers 206B and 206C.

FIG. 2C shows that the input port 203A of the first layer 202 may be aligned at least in part with the first waveguide 205 of the second layer 204, and that the first waveguide 205 of the second layer 204 may be aligned at least in part with the through-hole(s) 207 of the third layer 206. In some examples, and as shown, the holes in each layer may be of different sizes (e.g., width, diameter, etc.). For instance, the first waveguide 205 of the second layer 204 may be of a different size compared to respective sizes of the waveguides and/or through-hole(s) of the first 202, third 206, fourth 208, and/or fifth 210 layers. In general, one or more respective waveguides and/or through-hole(s) of the apparatus 200 may be of the same or different size as another one or more respective waveguides and/or through-hole(s) of the apparatus 200. The width of the waveguide channels may be adjusted (e.g., adjust metal plating thickness) in order to tune performance (e.g., resonance characteristics, signal phases) of the PWTL.

Having waveguides and/or through-hole(s) of different sizes as depicted may help in tuning resonance characteristics in the electromagnetic waves propagating through respective signal interconnections or paths defined by respective waveguides and/or through-hole(s). As an example, the through-hole(s) 207 of the third layer 206 that connects the first waveguide 205 of the second layer 208 to the second waveguide 209 of the fourth layer 208 may be referred to as an aperture, resonant slot, coupling channel, or slotted waveguide channel (SWGC). Dimensions and numbers of these through-hole(s) 207 of the third layer 206 can be selected to tune resonance and filtering characteristics of the apparatus.

As described above, in some examples, a conducting adhesive such as solder paste may be applied to at least edges of the waveguide channels (e.g., surrounding the waveguide channels) so as to at least partially align the waveguide channels with each other and define an electromagnetic wave path through which electromagnetic waves (e.g., millimeter waves) may propagate. In other words, the conducting adhesive may couple waveguide channels together, such as the metal-plated through-holes 205, 209 of the second and fourth layers 204, 208, so as to form a longer waveguide channel comprising the shorter waveguide channels of each respective layer. For instance, conducting adhesive 216A, 216B, 216C, and 216D may be provided to at least the edges surrounding the plated waveguide channel 205 of the second layer 204 so as to couple the second layer 204 between the first layer 202 and the third layer 206, and conducting adhesive 218A, 218B, 218C, and 218D may be provided to at least the edges surrounding the plated waveguide channel 209 of the fourth layer 208 so as to couple the fourth layer 208 between the third layer 206 and the fifth layer 210. The conducting adhesive may provide sufficient adhesion for coupling each layer together.

Additionally or alternatively to the conducting adhesive, other adhesive layers, either conducting or non-conducting, may be positioned between respective layers of the apparatus 200 to couple the respective layers together. For instance, adhesive layer 220A can be positioned between the first layer 202 and the second layer 204, adhesive layer 220B can be positioned between the second layer 204 and the third layer 206, adhesive layer 220C can be positioned between the third layer 206 and the fourth layer 208, and adhesive layer 220D can be positioned between the fourth layer 208 and the fifth layer 210. In some examples, a subset of the adhesive layers 220A, 220B, 220C, and 220D may be used.

Figure 2D:
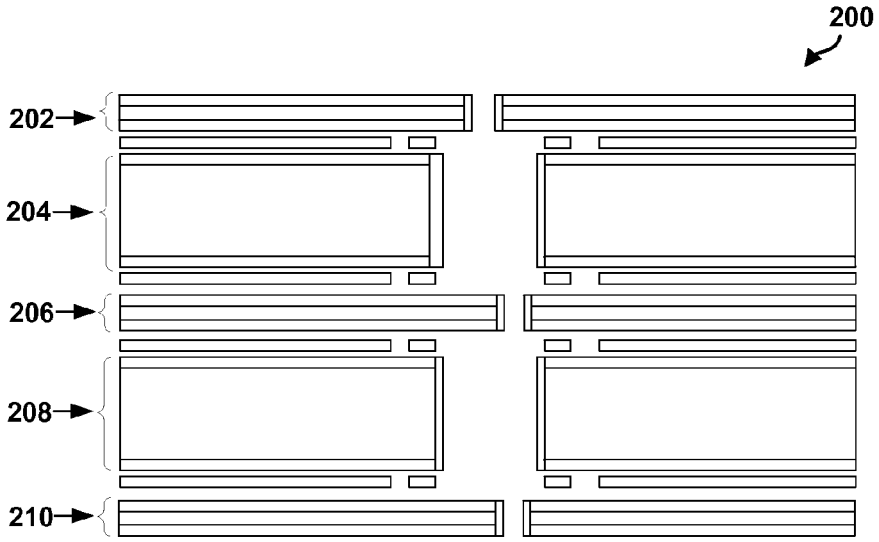
FIG. 2D illustrates an assembled view of the cross section of the example multi-layer apparatus.

FIG. 2D illustrates an assembled view of the cross section of the apparatus 200. In some scenarios, pressure and heat can be applied to couple the layers of the apparatus 200 together. For instance, pressure and heat can be applied to one or both of the outermost layers of the apparatus 200 (i.e., the first layer 202 and the fifth layer 210) to couple or bind the respective layers together using the conducting adhesives 216A, 216B, 216C, and 216D, or 218A, 218B, 218C, and 218D and/or the other adhesive layers 220A, 220B, 220C, and 220D between the respective layers. In some examples, the other adhesive layers 220A, 220B, 220C, and 220D may take the shape and size of the respective layers 202, 204, 206, 208, 210 that the other adhesive layers 220A, 220B, 220C, and 220D are coupled to. In other examples, such adhesive layers 220A, 220B, 220C, and 220D may take different shapes and sizes.

In some examples, pressure can be applied, by, for example, a plunger, on substantially an entire layer (e.g., the first layer 202 and/or the fifth layer 210) to couple the respective layers of the apparatus 200 together. The plunger, in these examples, may be referred to as a macro plunger. In other examples, an adhesive material or solder paste can be applied at discrete locations between the respective layers of the apparatus 200 as depicted by the conducting adhesives 216A, 216B, 216C, and 216D or 218A, 218B, 218C, and 218D shown in FIG. 2C. In these examples, a plunger can be used to apply pressure at the discrete locations. In this case, the plunger may be referred to as a micro plunger. The non-conducting adhesive material can be any type of adhesive appropriate for the material of the respective layers of the apparatus 200. As an example, the adhesive can include polymerizable material that can be cured to bond the layers together. Curing involves the hardening of a polymer material by cross-linking of polymer chains, and curing may be, for example, brought about by chemical additives, ultraviolet radiation, electron beam, and/or heat. In an example, the polymerizable material may be made of a light-curable polymer material that can be cured using ultraviolet (UV) light or visible light. In addition to light curing, other methods of curing are possible as well, such as chemical additives and/or heat. Any other type of adhesive and bonding method can be used to couple the respective layers of the apparatus 300 together.

It should be understood that additional layers, similar or different than the layers described herein, may be coupled to the apparatus 200 shown in FIGS. 2C and 2D. By adding more layers to the apparatus 200, a complex network of signal interconnections can be created to receive and transmit electromagnetic waves.

For example, in some embodiments the input port and/or the output port of the waveguide structure described above in relation to FIG. 2A may include one or more plated through-holes configured to function as a "coupling channels." These coupling channels may enable millimeter electromagnetic waves to propagate through the coupling channels and into another identical or different waveguide structure. For instance, in some embodiments, multiple PWTL structures (each including the layers described above) may be coupled together so as to form a longer waveguide transmission line, and the input port and/or output port may function as a coupling channel between PWTL structures. In such embodiments, a conducting material (e.g., a metallic material) may be deposited or plated on an inner surface(s) of the through-hole(s) to allow millimeter waves to travel through the coupling channel. Other embodiments are also possible.

Figure 3:
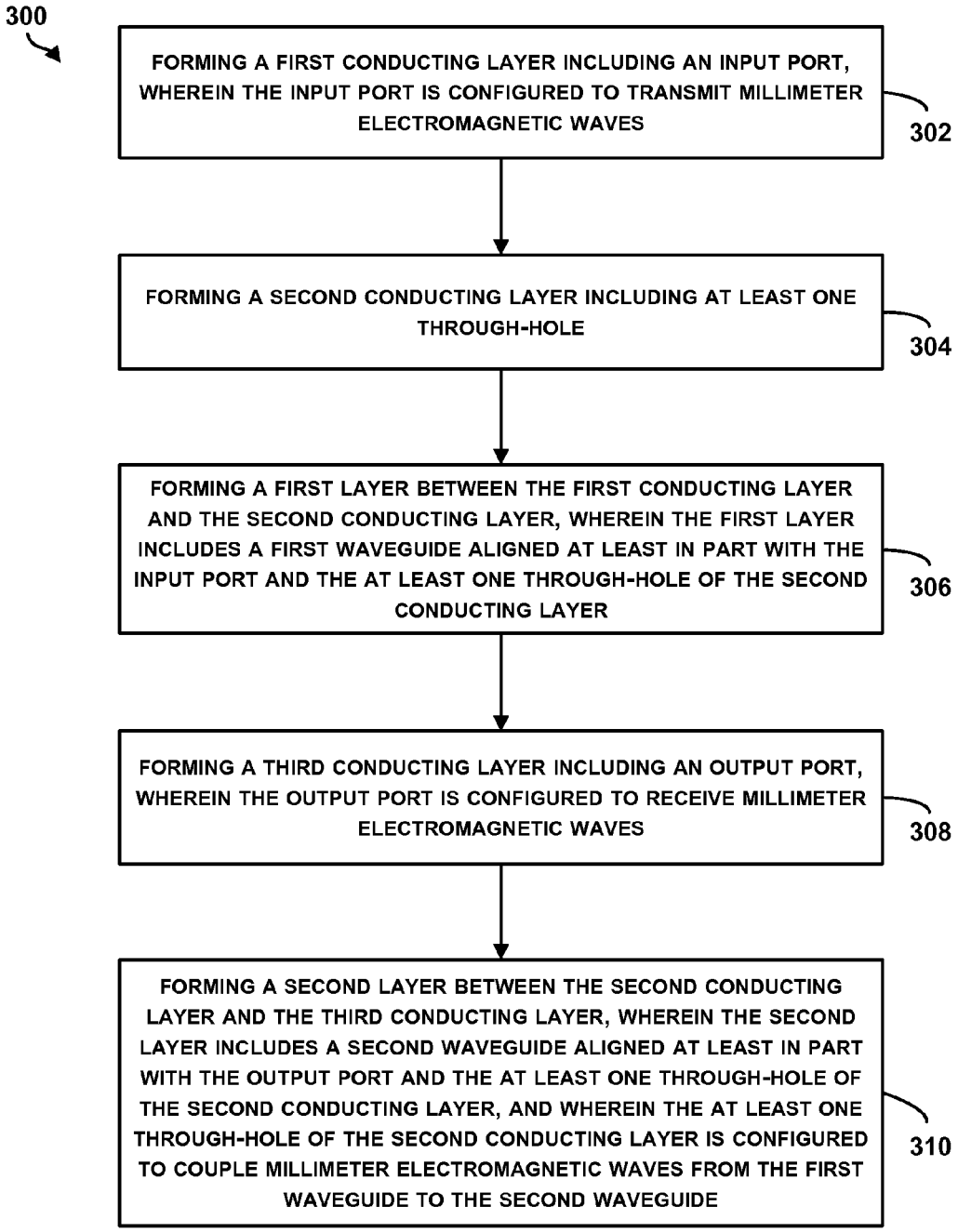
FIG. 3 is a flow chart of another method to form a coupling device using PWTLs, in accordance with an example embodiment.

FIG. 3 is a flow chart of another method 300 to form a coupling device using a PWTL. The PWTL, such as that described by the method 300, may be fabricated using components such as conducting layers, metal layers, and dielectric laminate layers. It should be understood that other methods of fabrication are also possible.

The method 300 may include one or more operations, functions, or actions as illustrated by one or more of blocks 302, 304, 306, 308, and 310. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 302, the method 300 includes forming a first conducting layer including an input port, wherein the input port is configured to transmit millimeter electromagnetic waves. As noted above, the first conducting layer may, for example, be made of a foil or sheet metal, and may include copper, aluminum, or any other conducting materials. In some examples, the first conducting layer may include a Kapton™ layer or other laminate coupled to the first conducting layer. In other examples, another conducting copper layer may be coupled to the Kapton™ layer from the other side of the Kapton™ layer such that the Kapton™ layer is sandwiched between two conducting layers. In one example, the input port may be a WR-10 flange. In general, it should be understood that one or more aspects of the first conducting layer may be similar to aspects described above with respect to layer 202 of FIG. 2A.

At block 304, the method 300 includes forming a second conducting layer including at least one through-hole. In some examples, forming the through-hole(s) may expose non-conducting inner surfaces of the second conducting layer. In these examples, a metallic plating or other thin metal surface may be provided (e.g., deposited) on the inner surface of the through-hole(s), as discussed above. It should be understood that one or more aspects of the second conducting layer may be similar to aspects of the first conducting layer just described, and/or to aspects described above with respect to layer 206 of FIG. 2A.

At block 306, the method 300 includes forming a first layer between the first conducting layer and the second conducting layer, wherein the first layer includes a first waveguide that is aligned at least in part with the input port and the at least one through-hole of the second conducting layer. In some examples, the first layer may include a metal layer, such as aluminum or a layer made of one or more metallic materials. In such examples, because the inner surface of the first waveguide is a conducting surface, there may be no need to plate or otherwise metallize the at least one through-hole so as to form a waveguide channel. Further, in such examples, the first layer may be coupled directly between two layers of foil or sheet metal (e.g., the first and second conducting layers). The first layer, first conducting layer, and second conducting layer may be coupled using conducting adhesive and/or non-conducting adhesive as described above. In other examples, the first layer may include a dielectric layer coupled between two conducting layers (e.g., a PCB). In such examples, a metallic plating or other thin metal surface may be provided (e.g., deposited) on the inner surface of the first waveguide, as discussed above. It should be understood that one or more aspects of the first layer may be similar to aspects described above with respect to layer 204 of FIG. 2A.

At block 308, the method 300 includes forming a third conducting layer including an output port, wherein the output port is configured to receive millimeter electromagnetic waves. In one example, the input port may be a WR-10 flange. It should be understood that one or more aspects of the third conducting layer may be similar to aspects of the first conducting layer and/or second conducting layer just described, and/or to aspects described above with respect to layer 210 of FIG. 2A.

At block 310, the method 300 includes forming a second layer between the second conducting layer and the third conducting layer, wherein the second layer includes a second waveguide that is aligned at least in part with the output port and the at least one through-hole of the second conducting layer. The at least one through-hole of the second conducting layer is configured to couple millimeter electromagnetic waves from the first waveguide to the second waveguide. It should be understood that one or more aspects of the second layer may be similar to aspects of the first layer just described, and/or to aspects described above with respect to layer 208 of FIG. 2A. Further, all layers described with respect to method 300 may be coupled/adhered using conducting adhesives, non-conducting adhesives, and/or other adhesives and adhesion methods not described herein.

As discussed above with respect to FIG. 2A, the first waveguide 205 in layer 204 and/or the second waveguide 209 in layer 208 may include a single waveguide channel. In other embodiments, the first waveguide and/or the second waveguide may include multiple waveguide channels coupled together. These waveguide channels may be formed by drilling, routing, reaming, etching, or otherwise machining the respective layer. The size and shape of each waveguide channels may be adjusted in order to tune performance (e.g., resonance characteristics, signal phases) of each channel. Coupling between such waveguide channels may be achieved through one or more of a through-hole, aperture, resonant slot, coupling channel, or slotted waveguide channel (SWGC). FIGS. 4A, 4B, 5A, 5B, 6A, 6B, 7A, and 7B describe examples of waveguides including multiple waveguide channels.

Figure 4A:
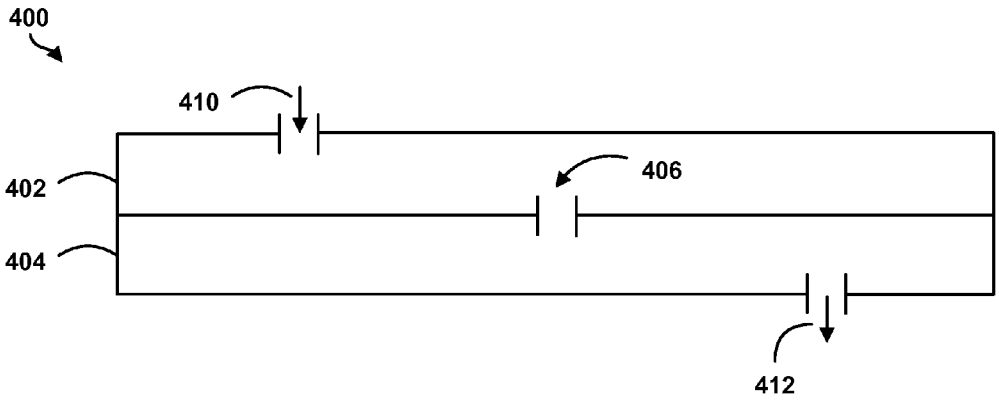
FIG. 4A illustrates a two-dimensional view of a two-layer PWTL directional coupler, in accordance with an example embodiment.

FIG. 4A illustrates a two-dimensional view of a two-layer PWTL directional coupler, in accordance with an example embodiment. The directional coupler 400 includes a first waveguide channel 402 substantially parallel to a second waveguide channel 404. The first waveguide channel 402 is coupled to the second waveguide channel 404 through coupling channel 406. Coupling channel 406 may include a single through-hole, multiple through-holes, one or more slots, or any other means for coupling the first waveguide channel 402 to the second waveguide channel 404.

In operation, the coupler 400 may receive millimeter electromagnetic waves through an input 410 into the first waveguide channel 402. Some of the waves from the first waveguide channel 402 may be coupled through the coupling channel 406 into the second waveguide channel 404. Those waves may then be transmitted to another component (such as to the third layer 206 in FIG. 2A, for example) via an output 412.

Figure 4B:
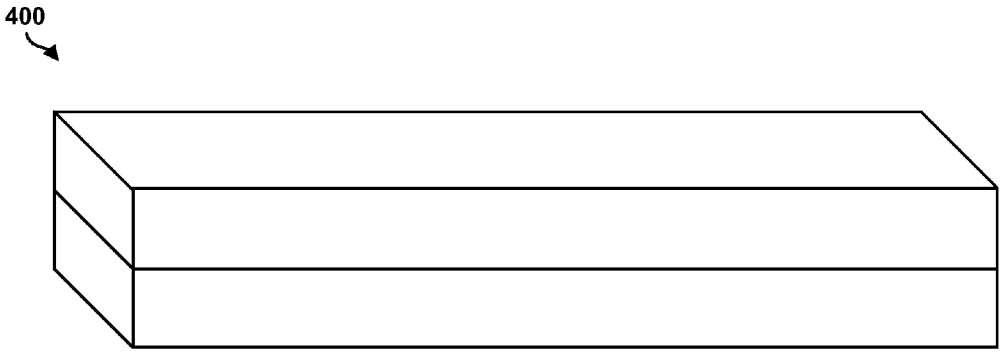
FIG. 4B illustrates a three-dimensional view of a two-layer PWTL directional coupler, in accordance with an example embodiment.

Such a coupler is similar to a Bethe-hole coupler. The concept of the Bethe-hole coupler can be extended by providing multiple coupling holes. In one example, the holes may be placed a distance of $\lambda/4$ apart, where $\lambda$ is the wavelength of the millimeter electromagnetic wave. Using multiple holes allows the bandwidth to be extended by designing the sections as a Butterworth, Chebyshev, or some other filter class. The hole size may be adjusted to achieve the desired coupling for each section of the filter. Further, the length and depth of each waveguide channel may be altered to adjust the resonant frequency. FIG. 4B illustrates a three-dimensional view of the two-layer PWTL directional coupler 400 described above in relation to FIG. 4A.

Figure 5A:
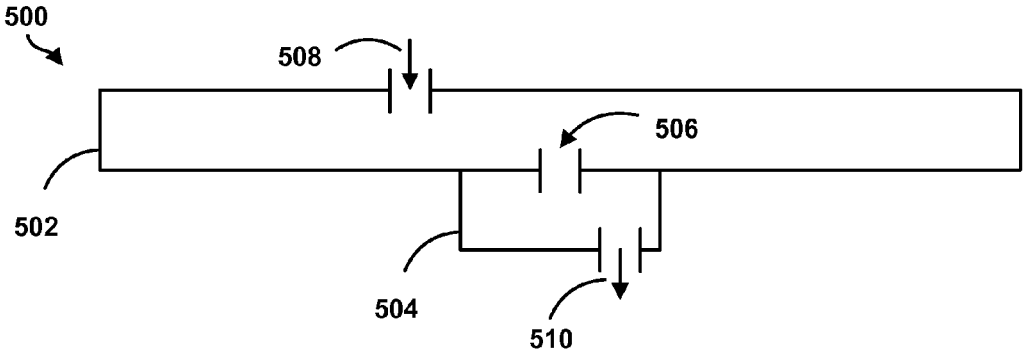
FIG. 5A illustrates a two-dimensional view of a two-layer PWTL cross-coupler, in accordance with an example embodiment.
Figure 5B:
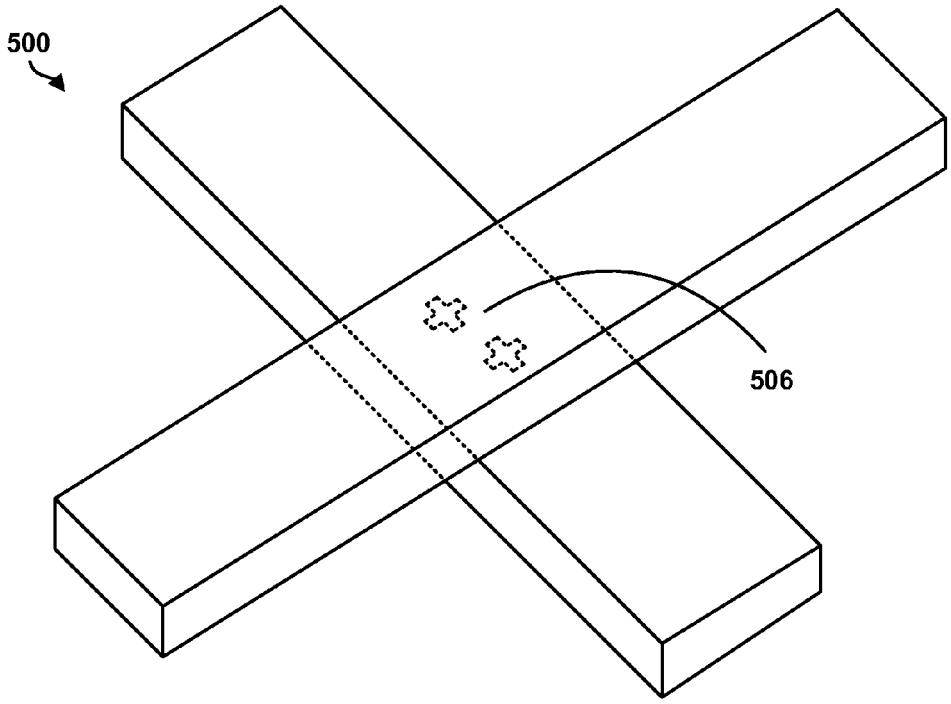
FIG. 5B illustrates a three-dimensional view of a two-layer PWTL cross-coupler, in accordance with an example embodiment.

FIG. 5A illustrates a two-dimensional view of a two-layer PWTL cross-coupler, in accordance with an example embodiment. The cross-coupler 500 includes a first waveguide channel 502 substantially perpendicular to a second waveguide channel 504. The first waveguide channel 502 is coupled to the second waveguide channel 504 through coupling channel 506. Coupling channel 506 may include a single through-hole, multiple through-holes, one or more slots, or any other means for coupling the first waveguide channel 502 to the second waveguide channel 504. FIG. 5B illustrates a three-dimensional view of the two-layer PWTL cross-coupler 500 described above in relation to FIG. 5A. In FIG. 5B, the coupling channel 506 may include two crossshaped off-center holes. Such a coupler is similar to a Moreno coupler. In one embodiment, the holes may be cut on the diagonal between the waveguides at a distance $$\frac{\sqrt{2}}{4}\lambda$$

apart. Other embodiments are possible as well.

In operation, the coupler 500 may receive millimeter electromagnetic waves through an input 508 into the first waveguide channel 502. Some of the waves from the first waveguide channel 502 may be coupled through the coupling channel 506 into the second waveguide channel 504. Those waves may then be transmitted to another component (such as to the third layer 206 in FIG. 2A, for example) via an output 510.

Figure 6A:
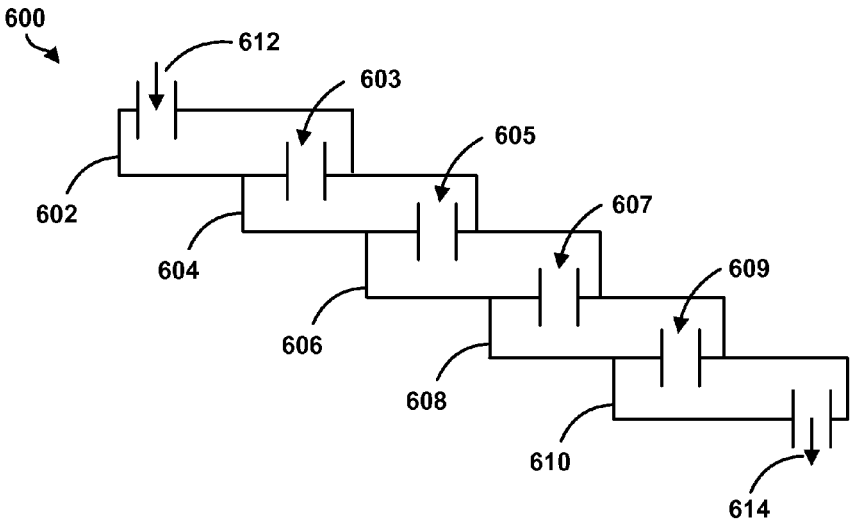
FIG. 6A illustrates a two-dimensional view of a multi-layer PWTL side-coupled filter, in accordance with an example embodiment.

FIG. 6A illustrates a two-dimensional view of a multi-layer PWTL side-coupled filter, in accordance with an example embodiment. The side-coupled filter 600 includes a first waveguide channel 602 adjacent to a second waveguide channel 604. The side-coupled filter also includes a third waveguide channel 606 adjacent to the second waveguide channel 604. The side-coupled filter also includes a fourth waveguide channel 608 adjacent to the third waveguide channel 606. The side-coupled filter also includes a fifth waveguide channel 610 adjacent to the fourth waveguide channel 608. The first waveguide channel 602 is coupled to the second waveguide channel 604 through coupling channel 603. The second waveguide channel 604 is coupled to the third waveguide channel 606 through coupling channel 605. The third waveguide channel 606 is coupled to the fourth waveguide channel 608 through coupling channel 607. Finally, the fourth waveguide channel 608 is coupled to the fifth waveguide channel 610 through coupling channel 609. The coupling channels may include a single through-hole, multiple through-holes, one or more slots, or any other means for coupling waveguide channels.

Figure 6B:
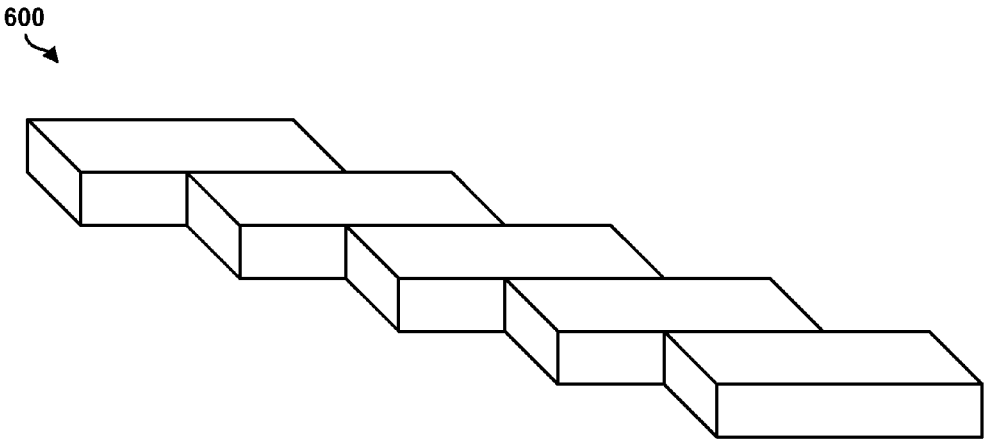
FIG. 6B illustrates a three-dimensional view of a multi-layer PWTL side-coupled filter, in accordance with an example embodiment.

In operation, the side-coupled filter 600 may receive millimeter electromagnetic waves through an input 612 into the first waveguide channel 602. Some of the waves from the first waveguide channel 602 may be coupled through the coupling channel 603 into the second waveguide channel 604. Next, some of the waves from the second waveguide channel 604 may be coupled through the coupling channel 605 into the third waveguide channel 606. Further, some of the waves from the third waveguide channel 606 may be coupled through the coupling channel 607 into the fourth waveguide channel 608. Finally, some of the waves from the fourth waveguide channel 608 may be coupled through the coupling channel 609 into the fifth waveguide channel 610. Those waves may then be transmitted to another component (such as to the third layer 206 in FIG. 2A, for example) via an output 614. FIG. 6B illustrates a three-dimensional view of the multi-layer PWTL side-coupled filter 600 described above in relation to FIG. 6A.

Figure 7A:
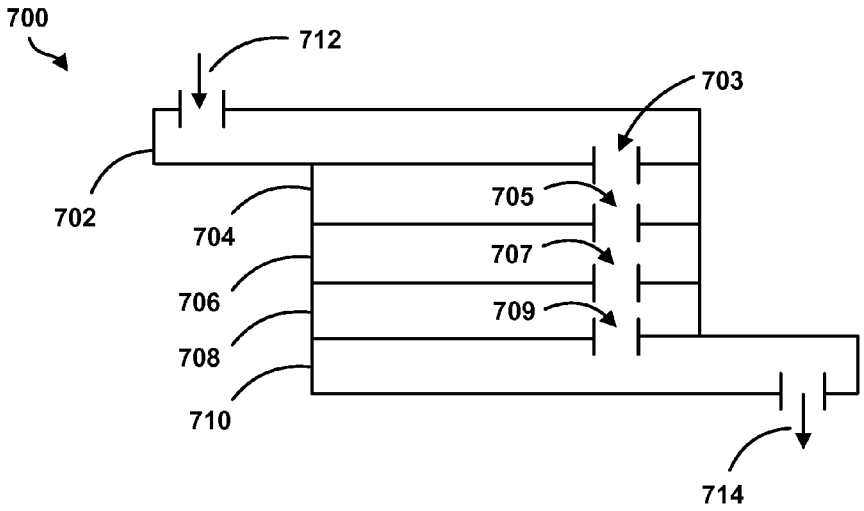
FIG. 7A illustrates a two-dimensional view of a multi-layer PWTL broadside-coupled filter, in accordance with an example embodiment.

FIG. 7A illustrates a two-dimensional view of a multi-layer PWTL broadside-coupled filter 700, in accordance with an example embodiment. Similar to the side-coupled filter described above, the broadside-coupled filter may include five waveguide channels 702, 704, 706, 708, 710 coupled together with four coupling channels 703, 705, 707, 709. However, the coupling channels of the side-coupled filter are located on the narrow side of the waveguides, where the coupling channels of the broadside-coupled filter are located on the wide or broad side of the waveguides.

Figure 7B:
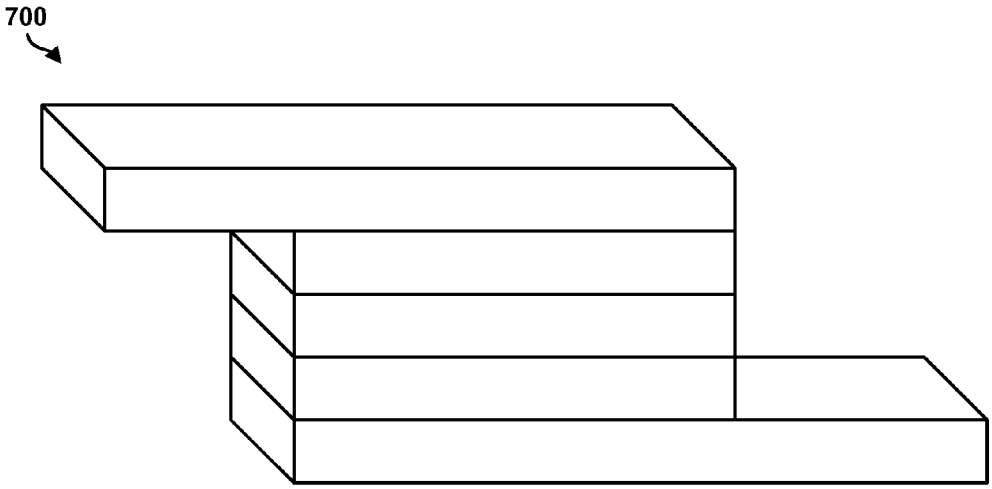
FIG. 7B illustrates a three-dimensional view of a multi-layer PWTL broadside-coupled filter, in accordance with an example embodiment.

In operation, the broadside-coupled filter 700 may receive millimeter electromagnetic waves through an input 712 into the first waveguide channel 702. The waves may be coupled through the coupling channels 703, 705, 707, 709 to the fifth waveguide channel 710. Those waves may then be transmitted to another component (such as to the third layer 206 in FIG. 2A, for example) via an output 714. In FIG. 7A, the coupling channels 703, 705, 707, 709 are aligned vertically. In another embodiment, the coupling holes may be staggered so that they are no longer aligned. Other combinations and locations of the coupling channels are possible as well. FIG. 7B illustrates a three-dimensional view of the multi-layer PWTL broadside-coupled filter 700 described above in relation to FIG. 7A.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A multi-layer apparatus comprising:

a first conducting layer including an input port, wherein the input port is configured to transmit millimeter electromagnetic waves;

a second conducting layer including at least one through-hole;

a first layer between the first conducting layer and the second conducting layer, wherein the first layer includes a first waveguide including a through-hole of greater width than the at least one through hole of the second conducting layer, and wherein the through-hole of the first waveguide is aligned at least in part with the input port and the at least one through-hole of the second conducting layer;

a third conducting layer including an output port, wherein the output port is configured to receive millimeter electromagnetic waves; and a second layer between the second conducting layer and the third conducting layer, wherein the second layer includes a second waveguide including a through-hole of greater width than the at least one through hole of the second conducting layer, wherein the through-hole of the second waveguide is aligned at least in part with the output port and the at least one through-hole of the second conducting layer, and wherein the at least one through-hole of the second conducting layer is configured to couple millimeter electromagnetic waves from the first waveguide to the second waveguide.

2. The apparatus of claim 1, further comprising a respective adhesive layer between one or more of:

the first conducting layer and the first layer, the first layer and the second conducting layer, the second conducting layer and the second layer, and the second layer and the third conducting layer.

3. The apparatus of claim 1, wherein the first layer and the second layer comprise a dielectric material, and wherein a metallic material is deposited on respective inner surfaces of the at least one through-hole of the second conducting layer, and of the first waveguide and the second waveguide.

4. The apparatus of claim 1, wherein the first layer and the second layer includes a metallic material.

5. The apparatus of claim 1, wherein the first layer and the second layer includes a printed circuit board (PCB).

6. The apparatus of claim 1, wherein the first waveguide comprises:

a first waveguide channel;

a second waveguide channel coupled to the first waveguide channel;

a third waveguide channel coupled to the second waveguide channel;

a fourth waveguide channel coupled to the third waveguide channel; and a fifth waveguide channel coupled to the fourth waveguide channel.

7. The apparatus of claim 1, wherein the input port and the output port include WR-10 flanges.

8. The apparatus of claim 1, wherein the first waveguide comprises:

a first waveguide channel;

a second waveguide channel substantially parallel to the first waveguide channel; and at least one hole for coupling the first waveguide channel to the second waveguide channel.

9. The apparatus of claim 1, wherein the first waveguide comprises:

a first waveguide channel;

a second waveguide channel substantially perpendicular to the first waveguide channel; and at least one hole for coupling the first waveguide channel to the second waveguide channel.

10. A method comprising:

forming a first layer comprising a first dielectric layer coupled between a first conducting layer and a second conducting layer, wherein the first layer includes an input port configured to transmit millimeter electromagnetic waves;

forming a second layer coupled to the first layer and comprising a second dielectric layer coupled between a third conducting layer and a fourth conducting layer, wherein the second layer includes a first waveguide including a through-hole that is aligned at least in part with the input port;

forming a third layer coupled to the second layer and comprising a third dielectric layer coupled between a fifth conducting layer and a sixth conducting layer, wherein the third layer includes at least one through-hole that is aligned at least in part with the through-hole of the first waveguide, and wherein the through-hole of the first waveguide has a greater width than the at least one through hole of the third layer;

forming a fourth layer coupled to the third layer and comprising a fourth dielectric layer coupled between a seventh conducting layer and an eighth conducting layer, wherein the fourth layer includes a second waveguide including a through-hole of greater width than the at least one through hole of the third layer, and wherein the through-hole of the second waveguide is aligned at least in part with the at least one through-hole of the third layer; and forming a fifth layer coupled to the fourth layer and comprising a fifth dielectric layer coupled between a ninth conducting layer and a tenth conducting layer, wherein the fifth layer includes an output port configured to receive millimeter electromagnetic waves that is aligned at least in part with the second waveguide, and wherein the at least one through-hole of the third layer is configured to couple millimeter electromagnetic waves from the through-hole of the first waveguide to the through-hole of the second waveguide.

11. The method of claim 10, further comprising:

providing a respective adhesive layer between one or more of:

the first layer and the second layer, the second layer and the third layer, the third layer and the fourth layer, and the fourth layer and the fifth layer.

12. The method of claim 10, the method further comprising:

providing a conductive material plating on respective inner surfaces of the at least one through-hole of the third layer, and of the first waveguide and the second waveguide.

13. A method comprising:

forming a first conducting layer including an input port, wherein the input port is configured to transmit millimeter electromagnetic waves;

forming a second conducting layer including at least one through-hole;

forming a first layer between the first conducting layer and the second conducting layer, wherein the first layer includes a first waveguide including a through-hole of greater width than the at least one through hole of the second conducting layer, and wherein the through-hole of the first waveguide is aligned at least in part with the input port and the at least one through-hole of the second conducting layer;

forming a third conducting layer including an output port, wherein the output port is configured to receive millimeter electromagnetic waves; and forming a second layer between the second conducting layer and the third conducting layer, wherein the second layer includes a second waveguide including a through-hole of greater width than the at least one through hole of the second conducting layer, wherein the through-hole of the second waveguide is aligned at least in part with the output port and the at least one through-hole of the second conducting layer, and wherein the at least one through-hole of the second conducting layer is configured to couple millimeter electromagnetic waves from the first waveguide to the second waveguide.

14. The method of claim 13, wherein the first layer and the second layer comprise a respective dielectric material, the method further comprising:

providing a conductive material plating on respective inner surfaces of the at least one through-hole of the second conducting layer, and of the first waveguide and the second waveguide.

15. The method of claim 13, wherein the first layer and the second layer includes a metallic material.

16. The method of claim 13, wherein the first layer and the second layer includes a printed circuit board (PCB).

17. The method of claim 13, further comprising:

providing a respective adhesive layer between one or more of:

the first conducting layer and the first layer, the first layer and the second conducting layer, the second conducting layer and the second layer, and the second layer and the third conducting layer.

* * * * *